US010183189B2

(12) United States Patent
Westenberg

(10) Patent No.: US 10,183,189 B2
(45) Date of Patent: Jan. 22, 2019

(54) PHYSICAL THERAPY DEVICES AND SYSTEM FOR REHABILITATION OF LIMBS

(71) Applicant: The Lawton West Law Group LLC, Intervale, NH (US)

(72) Inventor: Lloyd Westenberg, Conway, NH (US)

(73) Assignee: The Lawton West Group LLC, Conway, NH (US)

( * ) Notice: Subject to any disclaimer, the term of this patent is extended or adjusted under 35 U.S.C. 154(b) by 57 days.

(21) Appl. No.: 14/976,503

(22) Filed: Dec. 21, 2015

(65) Prior Publication Data

US 2016/0175635 A1 Jun. 23, 2016

Related U.S. Application Data

(60) Provisional application No. 62/095,276, filed on Dec. 22, 2014, provisional application No. 62/204,620, filed on Aug. 13, 2015.

(51) Int. Cl.
*A63B 23/12* (2006.01)
*A63B 21/00* (2006.01)
(Continued)

(52) U.S. Cl.
CPC ..... *A63B 21/0004* (2013.01); *A63B 21/012* (2013.01); *A63B 21/4019* (2015.10);
(Continued)

(58) Field of Classification Search
CPC ..... A61H 1/0274; A63B 23/12
See application file for complete search history.

(56) References Cited

U.S. PATENT DOCUMENTS 6,942,605 B1 * 9/2005 Sukhovitsky ..... A63B 21/0004 2/24
8,226,533 B2 * 7/2012 Wessels ..... A63B 21/0004 482/105

(Continued)

FOREIGN PATENT DOCUMENTS

WO WO2014066933 5/2014

OTHER PUBLICATIONS

Fabrication Enterprises, Inc. Product Information for Skate Board ROM Exercisers; https://www.fab-ent.com/exercise/range-of-motion/skate-board-rom-exercisers/#101131; accessed online Feb. 9, 2018.

*Primary Examiner* — Loan H Thanh
*Assistant Examiner* — Rae Fischer
(74) *Attorney, Agent, or Firm* — Sheehan Phinney Bass & Green PA

(57) ABSTRACT

A physical therapy system includes a rehabilitation device with a limb supporting plate configured to support a limb of a patient, a fastener securing the limb to a first surface of the plate, and a plurality of sliding or rolling elements attached to a second surface of the plate. The rolling/sliding elements may facilitate movement of the plate without directional bias. A deployment surface includes a substantially flat surface configured so the limb rehabilitation device may roll or slide over the flat surface, first and second raised edges attached the flat surface, and a measuring scale to facilitate measurement of the range of motion of the limb rehabilitation device over the deployment surface. The first raised edge and the second raised edge are configured to confine motion of the limb rehabilitation device over the deployment surface.

10 Claims, 12 Drawing Sheets

(51) Int. Cl.

| | |
|---|---|
| ***A63B 21/012*** | (2006.01) |
| ***A63B 23/035*** | (2006.01) |
| *A63B 22/20* | (2006.01) |
| *A63B 21/015* | (2006.01) |
| *A63B 23/04* | (2006.01) |
| *A63B 22/00* | (2006.01) |
| *A63B 71/06* | (2006.01) |

(52) U.S. Cl.

CPC ..... *A63B 21/4021* (2015.10); *A63B 22/20* (2013.01); *A63B 23/0355* (2013.01); *A63B 23/03508* (2013.01); *A63B 21/00181* (2013.01); *A63B 21/015* (2013.01); *A63B 22/203* (2013.01); *A63B 23/0405* (2013.01); *A63B 23/1209* (2013.01); *A63B 2022/0094* (2013.01); *A63B 2071/0694* (2013.01); *A63B 2209/02* (2013.01); *A63B 2209/10* (2013.01); *A63B 2225/09* (2013.01)

(56) References Cited

U.S. PATENT DOCUMENTS

| | | | | |
|---|---|---|---|---|
| 8,966,681 | B2 * | 3/2015 | Burch ..... | A63B 21/1473 482/23 |
| 2004/0214692 | A1 * | 10/2004 | Koenig ..... | A63B 21/4037 482/23 |
| 2011/0166006 | A1 * | 7/2011 | Howard ..... | A63B 21/0004 482/141 |
| 2011/0237400 | A1 | 9/2011 | King et al. | |

* cited by examiner 400
450
422
FRONT VIEW 420
473
472
471
412
414
450
410
470
TOP VIEW

REAR VIEW 420
422
400
412
430
480

410
450
460
411
SIDE ELEVATION
460
460
400
411
420
450

460
BOTTOM VIEW
485
480

700

PHYSICAL THERAPY DEVICES AND SYSTEM FOR REHABILITATION OF LIMBS

CROSS-REFERENCE TO RELATED APPLICATIONS

This application claims the benefit of U.S. Provisional Patent Application Ser. No. 62/095,276, filed Dec. 22, 2014, entitled "Physical Therapy Device for Rehabilitation of Limbs," and also claims the benefit of U.S. Provisional Patent Application Ser. No. 62/204,620, filed Aug. 13, 2015, entitled "Physical Therapy Devices and System for Rehabilitation of Limbs," which are each incorporated by reference herein in their entirety.

FIELD OF THE INVENTION

The present invention relates to medical devices, and more particularly, is related to physical therapy devices and systems.

BACKGROUND OF THE INVENTION

Physical therapists assist patients by moving the body and/or limbs of the patients and teaching exercises to the patients during the healing process. The therapy can be targeted to treat muscles, joints, and connective tissue, and may even help to create new pathways in the brain. This may help the patient to recover more quickly.

FIG. 1 shows a first prior art arm skate 100. An arm skate is a physical therapy device intended to help patients having paralysis in the arm, for example from stroke, sports injuries, rotator cuff, and many other injuries or illnesses. The arm skate 100 is fashioned from a padded board 110 configured with straps 170 for securing the arm of the patient to the arm skate 100. As is typical for such devices, the arm skate 100 has swivel caster wheels 160. While the swivel casters 160 may be moved into positions where they roll with minimal resistance in two opposing directions, it requires additional force to move the arm skate 100 in any direction that is not aligned with the present orientation of the swivel caster wheels 160. This may be problematic or even detrimental for patients having minimal strength in their arms, for example, from injury or illness.

FIG. 2 shows a second prior art arm skate 200. The second arm skate 200 has a pad 280 attached to a rigid base board 210, and a single strap 270 attached to the pad 280. Additional cushioning material 285 is positioned between the arm of the patient and the pad 280. Like the first prior art arm skate 100, the second prior art arm skate 200 uses swivel caster wheels 260. FIG. 3 shows a third prior art arm skate 300, which includes removable/replaceable hand grips. There is a need in the industry to address one or more of the abovementioned shortcomings.

SUMMARY OF THE INVENTION

Embodiments of the present invention provide physical therapy devices and system for rehabilitation of limbs. Briefly described, the present invention is directed to a physical therapy system including a rehabilitation device with a limb supporting plate configured to support a limb of a patient, a fastener securing the limb to a first surface of the plate, and a plurality of sliding or rolling elements attached to a second surface of the plate. The rolling/sliding elements may facilitate movement of the plate without directional bias. A deployment surface includes a substantially flat surface configured so the limb rehabilitation device may roll or slide over the flat surface, first and second raised edges attached the flat surface, and a measuring scale to facilitate measurement of the range of motion of the limb rehabilitation device over the deployment surface. The first raised edge and the second raised edge are configured to confine motion of the limb rehabilitation device over the deployment surface.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1:
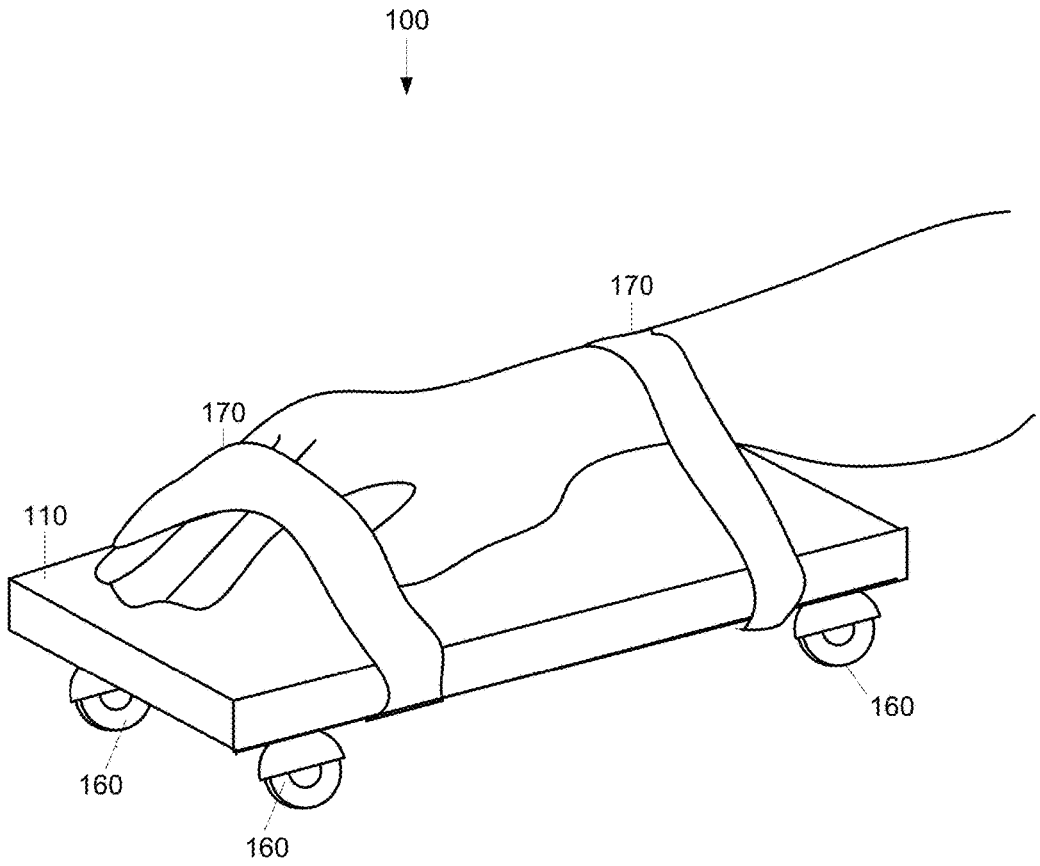
FIG. 1 (PRIOR ART)
FIG. 1 is a schematic diagram of a first prior art arm skate.
Figure 2:
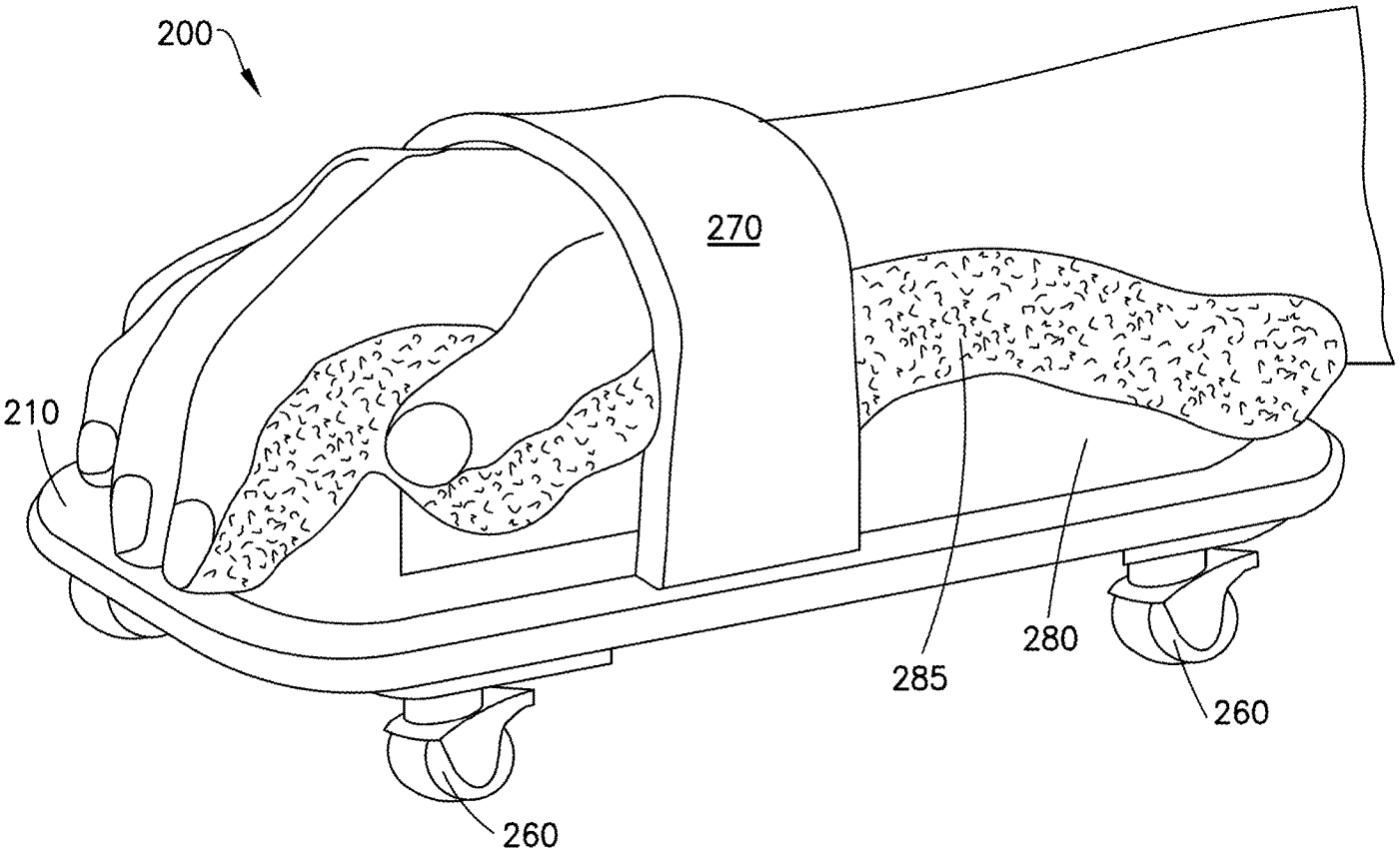
FIG.2 (PRIOR ART)
FIG. 2 shows a second prior art arm skate.
Figure 3:
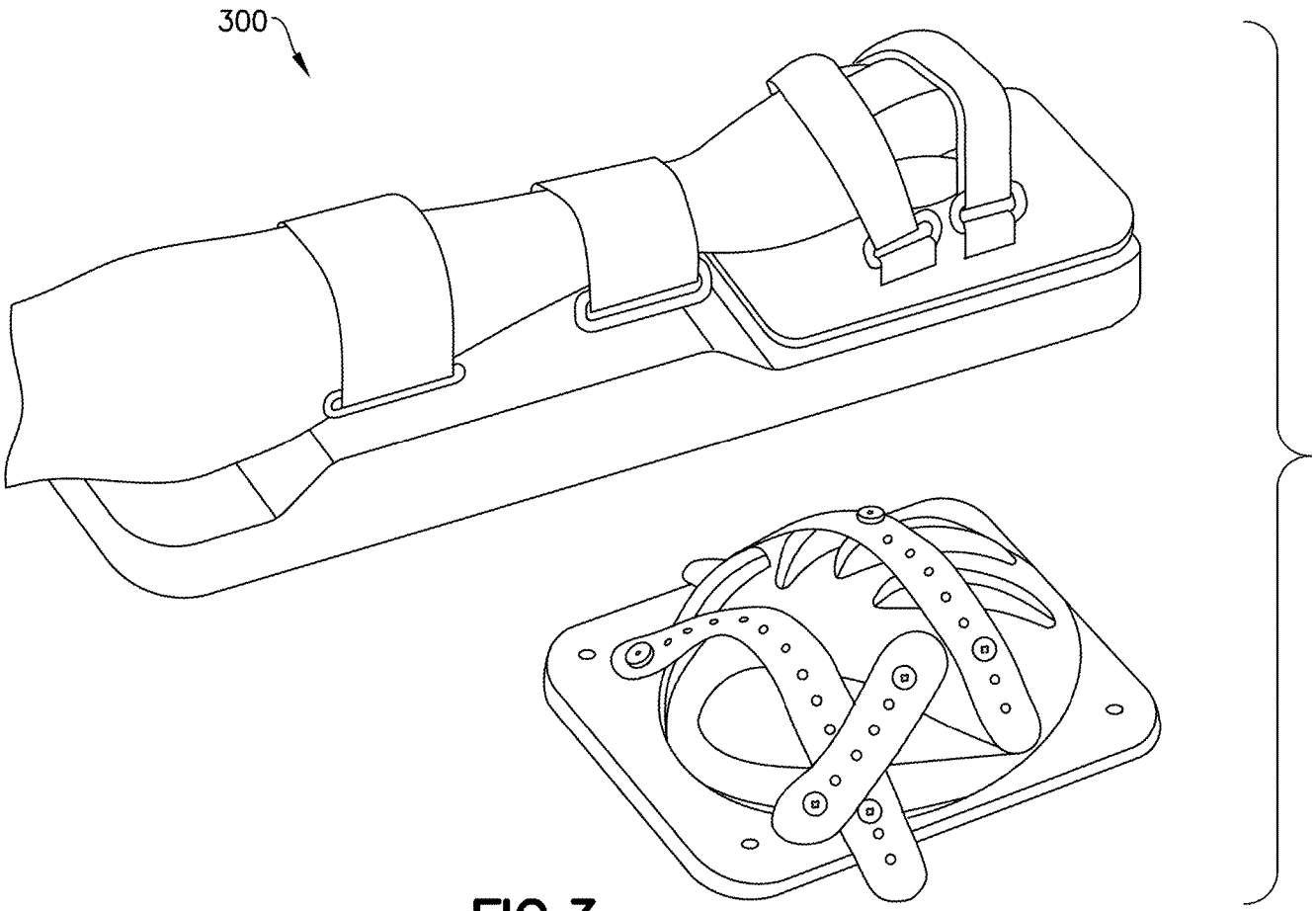
FIG.3 (PRIOR ART)
FIG. 3 shows a third prior art arm skate.
Figures 4A, 4B, 4C, 4D, 4E:
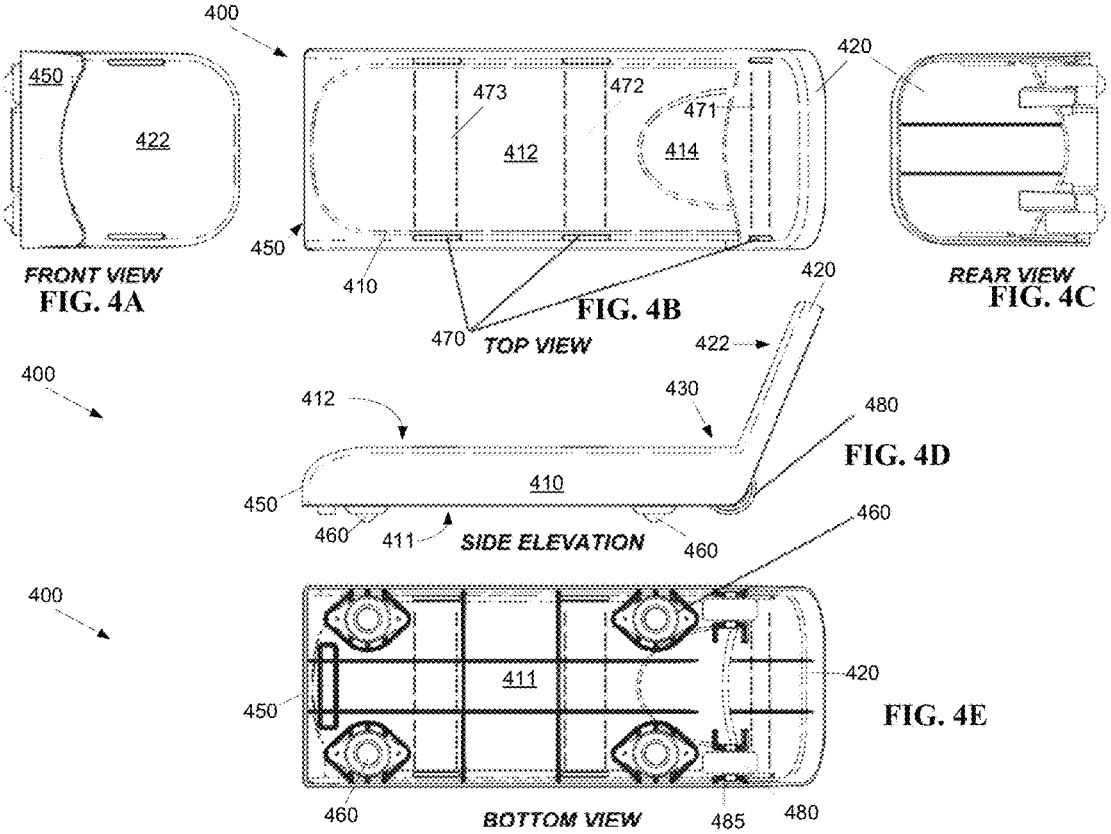
FIG. 4A is a schematic diagram of an exemplary embodiment of a rolling leg device from a front perspective.
FIG. 4B is a schematic diagram of the exemplary embodiment of a rolling leg device of FIG. 4A from a top view.
FIG. 4C is a schematic diagram of the exemplary embodiment of a rolling leg device of FIG. 4A from a rear view.
FIG. 4D is a schematic diagram of the exemplary embodiment of a rolling leg device of FIG. 4A from a side view.
FIG. 4E is a schematic diagram of the exemplary embodiment of a rolling leg device of FIG. 4A from a bottom view.

As used within this disclosure, a "limb" refers to an arm or a leg, in particular, a forearm or a foreleg. The term limb may be used to differentiate the arm from a hand, or the leg from a foot.

As used within this disclosure, "extremity" is a term referring to a hand or a foot attached to a limb.

As used within this disclosure, a "guide surface" refers to a surface used to support a rehabilitation device during use.

As used within this disclosure "substantially" means "very nearly," or within normal manufacturing tolerances. For example, a substantially flat surface indicates a surface that is flat within normal manufacturing tolerances.

Reference will now be made in detail to embodiments of the present invention, examples of which are illustrated in the accompanying drawings. Wherever possible, the same reference numbers are used in the drawings and the description to refer to the same or like parts.

Rolling Leg Device

An exemplary first embodiment of a rolling leg device 400, as shown by FIGS. 4A-4E, includes a leg plate 410 attached to a foot plate 420. The leg plate 410 connects to the foot plate 420 at a heel portion 430, and the leg plate 410 and the foot plate 420 may join at angle, for example, a 100 degree angle, although other angles may be used, for example but not limited to in the range of 75 degrees to 130 degrees, depending upon the desired bend at the heel of the patient. In alternative embodiments, the connection angle between the leg plate 410 and the foot plate 420 may be adjustable. The leg plate 410 and the foot plate 420 may be integrally formed, or the leg plate 410 and the foot plate 420 may be formed separately, and attached at the heel portion 430, for example, by an adhesive, a mechanical connection such as a cabinet corner joint, or the leg plate 410 and the foot plate 420 may be attached with fasteners, such as nails, screws or nuts and bolts, or other fastening means.

The leg plate 410 has an interior (top) surface 412 configured to be adjacent to the lower leg of the patient, and an exterior (bottom) surface 411 opposite the interior surface 412. A first side rail (not shown) and a second side rail (not shown) may optionally be attached to either side of the interior surface 412, to help secure the leg of the patient within the rolling leg device 400. The leg of the patient may be further secured to the interior surface 412 of the leg plate 410, for example, with one or more leg straps 472, 473, described below. The interior surface 412 of the leg plate 410 may be contoured to the shape of a leg. In addition to or instead of contours, padding may be added to the interior surface 412. A heel recess 414 may be formed in the leg plate 410 at the heel portion 430 in the vicinity of the foot plate 420 to better accommodate a heel of the patient.

The foot of the patient may be secured to a top surface 422 of the foot plate 420, for example, one or more foot straps 471. Like the leg plate interior surface 412, the top surface 422 of the foot plate 420 may be padded and/or contoured to better accommodate the foot of the patient.

The rolling leg device 400 may be fitted to either leg, and the abovementioned contouring may be configured to accommodate a right leg or a left leg. The rolling leg device 400 may be configured for various lengths, for example, extending just above the ankle of the patient, extending half way up the calf of the patient, or extending to the knee and above of the patient. The rolling leg device 400 may be, for example, approximately 18 inches long and 7 inches wide at a calf/knee portion 450. There may be a bevel, or dip, formed in the interior surface 422 of the foot plate 420 in the vicinity of the heel portion 430 shaped to fit the heel of the patient. The foot plate 420 may extend from the heel of the foot of the patient, to just below the toes, or beyond, and may be, for example, ¾ inches thick, 7 inches wide by 8 inches high, but may be shorter or longer as needed. Other dimensions are also possible. While there are no sides on the first embodiment of the foot plate 420, alternative embodiments of the foot plate 420 may include side rails, or may entirely enclose the foot of the patient.

Two rolling elements 480 are attached the heel portion 430. For example, at the underside or outside corner of the heel portion 430, there may be an axle 485 extending through an aperture in the rolling elements 480 at the heel portion 430 with one rolling element 480, such as a wheel rotatably attaching to the axle 485 at each outside corner. Alternatively, the rolling elements 480 may be attached to the foot plate 420 by other means, for example, a u-shaped clip attaching to indentations or an aperture at the center of the rolling elements 480, or a friction fit. For example the rolling elements 480 may be are approximately 1 inch wide by 2 inches high. The first embodiment includes two rolling elements 480, but alternative embodiments may have one, three, or more rolling elements 480. The rolling elements 480 are configured to roll in a generally fixed direction (forward and backward), and are generally not configured to swivel.

The leg plate 410, foot plate 420 and optional rails (not shown) are preferably formed of a rigid material such as wood, metal, or polymers, for example, a durable plastic, the rolling elements 480 may be made of plastic or rubber. The axle 485 may be made of metal or another suitably rigid material.

The rolling element(s) 480 are positioned at the heel portion 430 so that the rolling element(s) 480 may roll against a guide surface, for example, the floor, while the rolling leg device 400 is oriented at a range of angles with respect to the surface. For example, the rolling element(s) 480 may roll against the surface when the leg plate 410 is parallel or nearly parallel to the floor, when the leg plate 410 is at a 45 degree angle to the floor, when the foot plate 420 is substantially parallel to the floor, and at any and all positions there-between. The rolling elements 480 may be oriented such that the rolling leg device 400 may roll against a surface in a direction corresponding to the bending direction of a knee and/or ankle of the patient, thereby accommodating extension and retraction of the leg via bending of the knee.

There may be one or more leg straps 473, 472 and a foot strap 471 to secure the lower leg and the foot to the rolling leg device 400. For example, an upper leg strap 473 may be mounted at approximately three inches from the calf/knee portion 450, or just below the knee joint, and a lower leg strap may be attached to the leg plate 410 closer to the heel portion 430, for example, three inches above the heel portion 430, at the shin bone of the patient. A foot strap 471 may be located on the foot plate 420 just below the toes of the patient. Other strap locations are also possible. The straps 471, 472, 473 may be flexible straps, for example, medical straps, and may attach to the rolling leg device 400 by mechanical fasteners or adhesives, and the free ends of the straps may attach to each other by mechanical fasteners, such as buckles, snaps, buttons, hooks, ties, hook and loop fasteners such as Velcro®, or other fastening means. Alternatively, the straps 471, 472, 473 may pass through the leg plate 410 and/or foot plate 420 via strap apertures 470.

The leg plate 410, foot plate 420 and optional rails (not shown) are preferably formed of a rigid material such as wood, metal, or polymers, for example, a durable plastic, the rolling elements 480 may be made of plastic or rubber. The axel 485 may be made of metal or another suitably rigid material.

The rolling element(s) 480 may be configured so the rolling leg device 400 is biased to roll with an intended orientation with respect to the rolling leg device 400, and thereby with respect to the leg of the patient. In general, the rolling element(s) 480 are configured so the rolling leg device 400 rolls across a guide surface in accordance with the direction of the bend of the knee of the patient. For example, the axle 485 may be oriented substantially perpendicular to a longitudinal axis between the knee and heel of the patient when the patient is wearing the rolling leg device 400. The axle 485 and/or rolling element(s) 480 may be configured to be adjustable with regard to the rolling direction with respect to the orientation of the leg of the patient.

Under an alternative embodiment of the rolling leg device 400, one or more non-biased sliding/rolling elements 460 may optionally be disposed on an underside 411 of the leg plate 410, allowing the rolling leg device 400 to slide or roll with substantially equal, minimal resistance in any direction on an adjacent surface, for example, an angled board, a floor, or low table top. The sliding/rolling elements 460 may be configured to extend outward from the underside 411 of the leg plate 410 to provide clearance for the rolling element(s) 480, such that the sliding/rolling elements 460 may slide/roll against an adjacent surface without the rolling elements 480 contacting the adjacent surface.

Exemplary non-biased sliding/rolling elements 460 include a ball transfer caster, where a spherical rolling element is housed within a housing, allowing the spherical rolling element to rotate in any planar direction over a surface. In particular, the spherical rolling element 460 does not have an axle through it, or other element to restrict rotation of the spherical rolling element to any particular direction. For example, the spherical roiling element 460 may be formed of plastic or hard rubber, and the housing may be formed of metal or plastic. Another example of a non-biased sliding/rolling element 460 is a low friction skid, such as a self-lubricating polymer material that provides very little resistance to moving in any direction over certain smooth surfaces, for example, a floor surface coated with a similarly low friction polymer material.

The rolling leg device 400 may be used to allow a patient to gently exercise the knee by rolling the rolling leg device 400 so as to extend and retract the knee in forward and backward directions. Such movement may previously have been accomplished by a physical therapist directly manipulating the knee. The rolling leg device 400 provides an alternative where the patient may gently exercise the knee without assistance.

Low Bias Arm Rehabilitation Device

As mentioned above in the background section of the present application, some prior art physical therapy devices do not facilitate equal ease of motion in all planar directions. In particular, it may take more effort by the patient to overcome initial resistance to movement of the prior art arm skates in some directions than for others. It may be beneficial for patients starting rehabilitation to provide physical therapy devices facilitating the easiest type of exercise with minimal resistance in 360 degrees to slowly build up the muscles and tendons. This may be beneficial, for example, for stroke patients, who rely on brain cells to form new pathways around the damaged brain cells. The brain may more readily release good cells to help go around the damaged cells and then begin to actually help move the arm when there is minimal resistance to the intended movement.

Figure 5A:
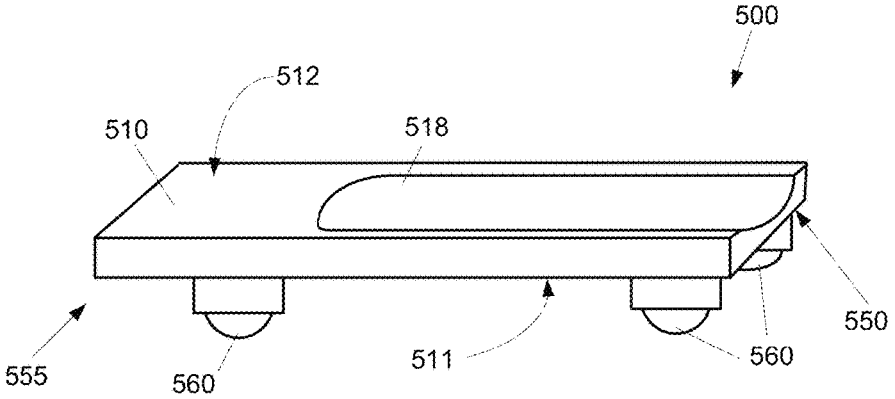
FIG. 5A is a schematic diagram of an exemplary embodiment of a low bias arm rehabilitation device from a front perspective.
Figure 5B:
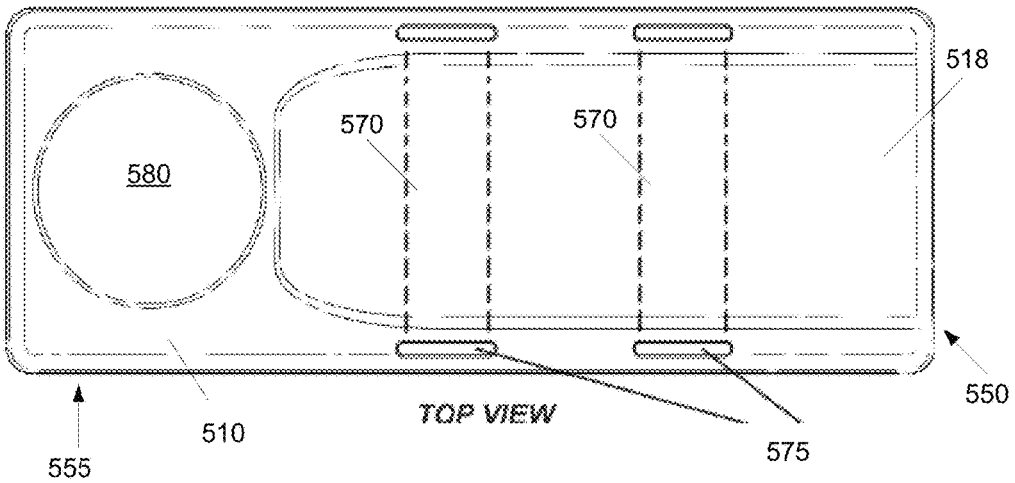
FIG. 5B is a schematic diagram of the exemplary embodiment of a low bias arm rehabilitation device of FIG. 5A from a top view.
Figure 5C:
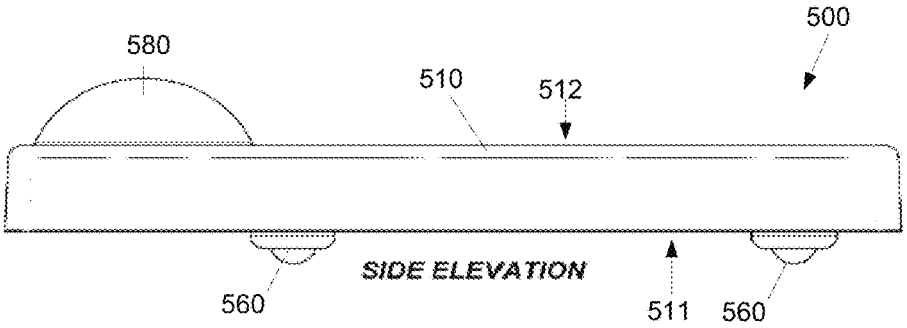
FIG. 5C is a schematic diagram of the exemplary embodiment of a low bias arm rehabilitation device of FIG. 5A from a side view.

An exemplary embodiment of an arm rehabilitation device 500 is shown in FIGS. 5A, 5B and 5C. The arm rehabilitation device 500 has an arm plate 510, configured to support the forearm of a patient. The arm plate 510 under the first embodiment is substantially rectangular in profile, but there is no objection to other shapes and profiles, for example, a profile where an elbow/forearm end 550 is wider than a hand end 555. Similarly, while the arm plate 510 in the first embodiment may have a substantially uniform edge width, the side profile of the arm plate 510 may be tapered to provide an inclined surface 512. The surface 512 of the arm plate 510 may be contoured to the shape of an arm, for example, by including a recess area 518.

The arm rehabilitation device 500 may be fitted to either arm, and the abovementioned contouring may be configured to accommodate a right arm or a left arm, or may be generically contoured to accommodate either arm. The arm rehabilitation device 500 may be configured for various lengths, for example, extending just above the wrist of the patient, extending half way up the forearm of the patient, or extending to the elbow and above of the patient. The arm rehabilitation device 500 may be, for example but not limited to, approximately 19 inches long and 6 inches wide at a forearm/elbow portion 550, and approximately ¾ inches thick. Other dimensions are also possible.

The recess 518 of the arm rehabilitation device 500 may be approximately ½ inch deep, up to 6 inches wide, and approximately 12 inches long, thereafter the last 7 inches of the surface 512 toward the forearm/elbow portion 550 may be substantially flat. A hand grip 580 may be disposed upon the flat portion of the surface 512, for example, a rounded 4 by 4 inch profile rising up to two inches above flat surface 512, for example, to fit the palm of the hand of the patient for comfort and stability. Other hand grips 580 may be used, or the hand grip 580 may be omitted. Optionally, the hand grip 580 may be removably attached, so that different hand grips 580 may be interchangeably used, for example, based on right or left handed use, the size of the hand of the patient, the nature of the injury, or other factors.

The arm of the patient may be secured by one or two straps 570, for example, a first strap 570 just above the wrist, and a second strap 570 just below the elbow. The straps 570 may attach to the arm rehabilitation device 500 by mechanical fasteners or adhesives, and the free ends of the straps may attach to each other by adhesive or mechanical fasteners, such as buckles, snaps, buttons, or hooks or hook and loop fasteners such as Velcro®. Alternatively, the straps 570 may pass through the arm plate 510 via strap apertures 575, as shown in FIG. 5B. The straps 570 may be attached to the arm plate 510, or may be attached to a pad or cushion (not shown) attached to the arm plate 510. The arm plate 510 is preferably formed of a rigid material, such as wood, metal, or polymer, for example, a durable plastic, or a hard rubber or similar material.

As noted above, previous arm skates impart a directional bias, or a preference for moving in some directions over others. For example, if swivel casters are oriented to move in a north-south direction, additional resistance must be overcome to re-orient the swivel casters in another direction, for example, an east-west direction. Under the first embodiment of the arm rehabilitation device 500, one or more non-biased sliding/rolling elements 560 are disposed on an underside 511 of the arm plate 510, allowing the arm rehabilitation device 500 to slide or roll with substantially equal, minimal resistance in any direction on an adjacent surface, for example, a floor, or table top.

Exemplary non-biased sliding/rolling elements 560 include a ball transfer caster, where a spherical rolling element is housed within a housing, allowing the spherical rolling element to rotate in any planar direction over a surface. In particular, the spherical rolling element 560 does not have an axle through it, or any other element to restrict rotation of the spherical rolling element to any particular direction. For example, the spherical roiling element 560 may be formed of plastic or hard rubber, and the housing may be formed of metal or plastic. Another example of a non-biased sliding/rolling element 560 is a low friction skid, such as a self-lubricating polymer material that provides very little resistance to moving in any direction over certain smooth surfaces, for example, a table surface coated with a similarly low friction polymer material.

The arm rehabilitation device 500 may help strengthen and rebuild muscles and tendons during rehabilitation and physical therapy. For example, the arm rehabilitation device 500 may help patients who have paralysis in the arm from stroke, sports injuries, rotator cuff, and other injuries or illnesses, to recovery. The arm rehabilitation device 500 may help patients trying to regain use of their arm. The arm rehabilitation device 500 rolls or slides in all planar directions with minimal resistance, for example, in all directions over a substantially flat surface, with no direction of movement preferred over another, due to the non-biased sliding/rolling elements 560. This type of rolling/sliding design allows the patient to move the arm in many different motions, for example, on a table, to rebuild muscles and tendons.

Low Bias Leg Rehabilitation Device

Figure 6A:
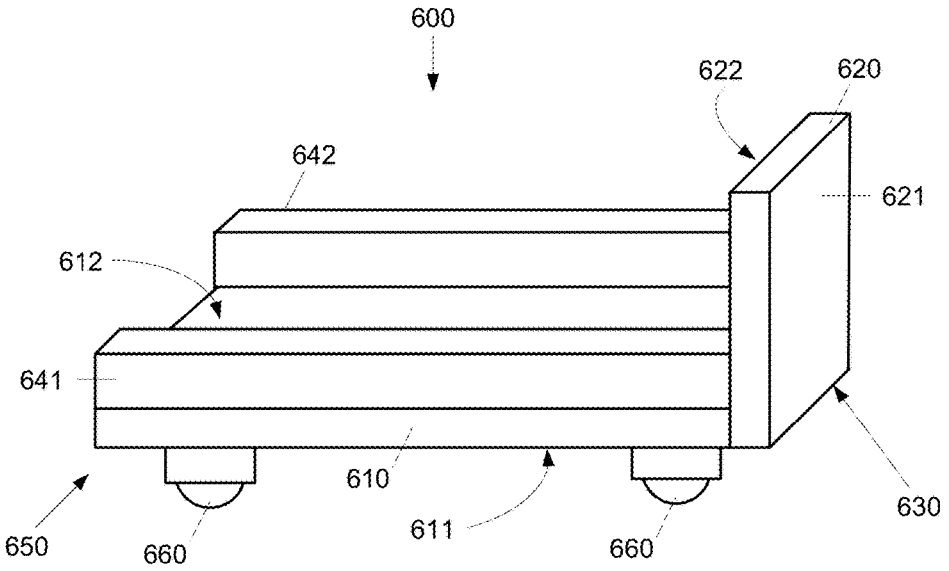
FIG. 6A is a schematic diagram of an exemplary embodiment of a low bias leg rehabilitation device from a first perspective.
Figure 6B:
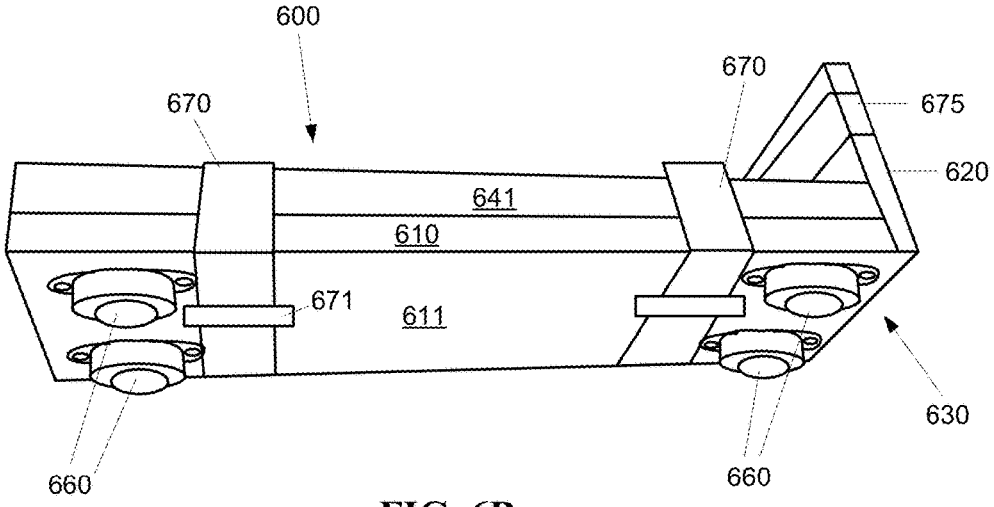
FIG. 6B is a schematic diagram of the exemplary embodiment of the low bias leg rehabilitation device of FIG. 6A from a second perspective.

An exemplary embodiment of a low bias leg rehabilitation device 600, shown in FIGS. 6A and 6B, includes a leg plate 610 attached to a foot plate 620. The leg plate 610 connects to the foot plate 620 at a heel portion 630, and the leg plate 610 and the foot plate 620 may join at angle, for example, a 90 degree angle, although other angles may be used, for example but not limited to in the range of 75 degrees to 120 degrees, depending upon the desired bend at the heel of the patient. In alternative embodiments, the connection angle between the leg plate 610 and the foot plate 620 may be adjustable. The leg plate 610 and the foot plate 620 may be integrally formed, for example, one piece molded, or the leg plate 610 and the foot plate 620 may be formed separately, and attached at the heel portion 630, for example, by an adhesive, a mechanical connection such as a cabinet corner joint, or the leg plate 610 and the foot plate 620 may be attached with fasteners, such as nails, screws or nuts and bolts.

The leg plate 610 has an interior surface 612 configured to be adjacent to the lower leg of the patient, and a bottom surface 611 opposite the interior surface 612. A first side rail 641 and a second side rail 642 may be attached to either side of the interior surface 612, to help secure the leg of the patient within the leg rehabilitation device 600. The leg of the patient may be further secured to the interior surface 622 of the leg plate 610 between the first side rail 641 and the second side rail 442, for example, with one or more leg straps 670, described further below. The interior surface 612 of the leg plate 610 may be contoured to the shape of a leg. In addition to or instead of contours, padding may be added to the interior surface 612.

The foot of the patient may be secured to a top surface 622 of the foot plate 420, for example, one or more foot straps 675. Like the leg plate interior surface 612, the top surface 622 of the foot plate 620 may be padded and/or contoured to better accommodate the foot of the patient.

The leg rehabilitation device 600 may be fitted to either leg, and the abovementioned contouring may be configured to accommodate a right leg or a left leg. The leg rehabilitation device 600 may be configured for various lengths, for example, extending just above the ankle of the patient, extending half way up the calf of the patient, or extending to the knee and above of the patient. The rolling leg rehabilitation device 600 may be, for example, approximately 19 inches long and 7 inches wide at a calf/knee portion 650, where the side rails 641, 642 may be on the order of two inches high. There may be a bevel, or dip formed in the interior surface of the leg plate 610 and/or the top surface of the foot plate 620 in the vicinity of the heel portion 630 shaped to fit the heel of the patient. The foot plate 620 extends from the heel of the foot, to just below the toes, or beyond, and may be, for example, 7 inches wide by 8 inches high. While there are no sides shown in FIGS. 6A-6B on foot plate 620, alternative embodiments of the foot plate 620 may include side rails, or may entirely enclose the foot of the patient. In other embodiments, the foot plate 621 may be omitted. The leg plate 610 and/or the foot plate 620 may be approximately ¾ inches thick, but may be thicker or thinner as desired, depending, for example, upon the type of material used.

Under the first embodiment of the leg rehabilitation device 600, one or more non-biased sliding/rolling elements 660 are disposed on a bottom surface 611 of the leg plate 610, allowing the leg rehabilitation device 600 to slide or roll with substantially equal, minimal resistance in any direction on an adjacent guide surface, for example, a floor, or low table top. The non-biased sliding/rolling elements 660 may be substantially similar to the non-biased sliding/rolling elements 560 (FIGS. 5A-5B) described above.

There may be one or more straps 670, 675 to secure the lower leg and the foot to the leg rehabilitation device 600. For example, an upper leg strap 670 may be mounted at approximately three inches from the calf/knee portion 650, or just below the knee joint, and a lower leg strap 670 may be attached to the leg plate 610 closer to the heel portion 630, for example, three inches above the heel portion 430, at the shin bone of the patient. A third strap 675 may be located on the foot plate 620 just below the toes of the patient. The straps may attach to the leg rehabilitation device 600 by mechanical fasteners or adhesives, and the free ends of the straps may attach to each other by mechanical fasteners, such as buckles, snaps, buttons, or hooks or hook and loop fasteners (medical fasteners) such as Velcro®. The leg plate 610, foot plate 620 and rails 641, 642 of the leg rehabilitation device 600 are preferably formed of a rigid material, such as wood, metal, or polymers, for example, a durable plastic, with an overall thickness in the range of 0.25 inches to one inch or more, preferably on the order of 0.75 inches.

The leg rehabilitation device 600 may be used, for example, to help physical therapy of rehabilitation patients who are recovering from stroke symptoms, knee replacement, sports injury, and many other types of leg problems. The leg rehabilitation device 600 helps rebuild muscles and tendons, prepares for walking again. The leg rehabilitation device 600 provides a smooth operation that may enable the patient to move the leg in an easy manner, with minimal restriction. This allows the patient to move muscles and tendons so they will strengthen with extended use.

Figure 7:
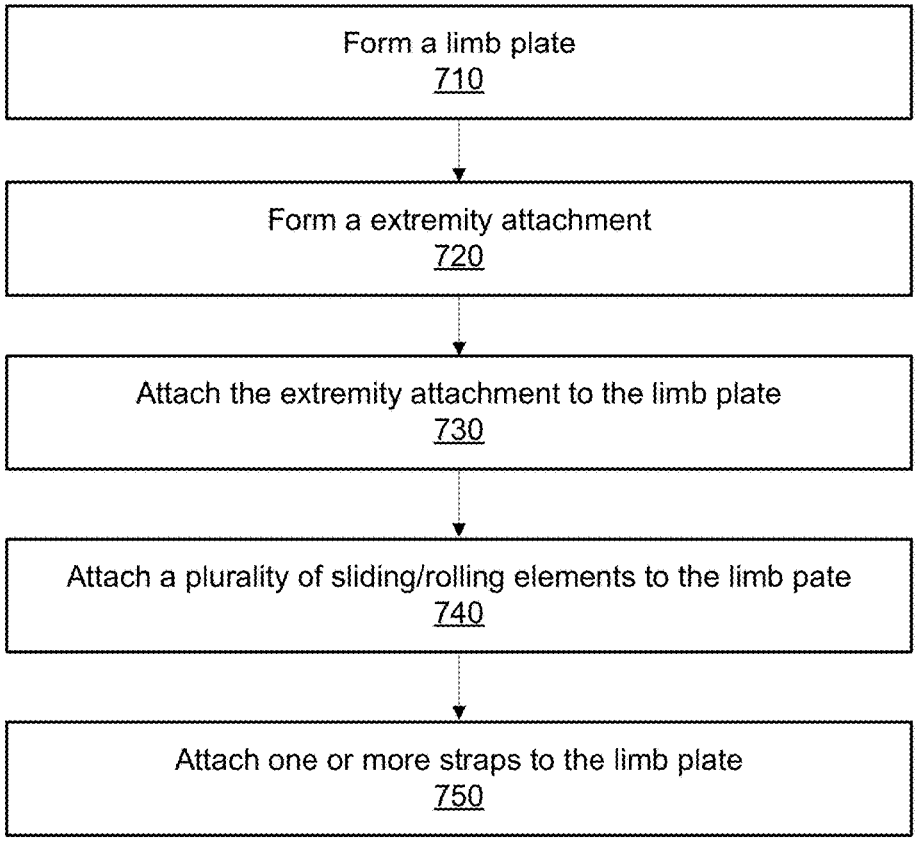
FIG. 7 is a flowchart of a method for forming a physical therapy device.

FIG. 7 is a flowchart of a method for forming a physical therapy device. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

The description of the method 700 of FIG. 7 is made with reference to FIGS. 4A-E, 5A-C, and 6A-B. A limb plate 410, 510, 610 is formed, as shown by block 710. The limb plate 410, 510, 610 may be configured to support an arm or a leg of a patient. The limb plate 410, 510, 610 may be formed of a suitably rigid material, for example, wood, plastic, or metal. An extremity attachment 420, 580, 620, is formed, as shown by block 720. The extremity attachment 420, 580, 620 may be formed of the same material as the limb plate 410, 510, 610, or another material suitable for supporting an extremity (hand or foot). The extremity attachment 420, 580, 620 is attached to the limb plate 410, 510, 610, as shown by block 730. Alternatively, the limb plate 410, 510, 610 and extremity attachment 420, 580, 620 may be integrally formed. A plurality of sliding/rolling elements 460, 560, 660 are attached to the limb plate 410, 510, 610, as shown by block 740. One or more straps 471-3, 570, 670 are attached to the limb plate 410, 510, 610, as shown by block 750. The straps 471-3, 570, 670 may be used to secure the limb of a patient to the limb plate 410, 510, 610.

Rehabilitation System

Figure 9A:
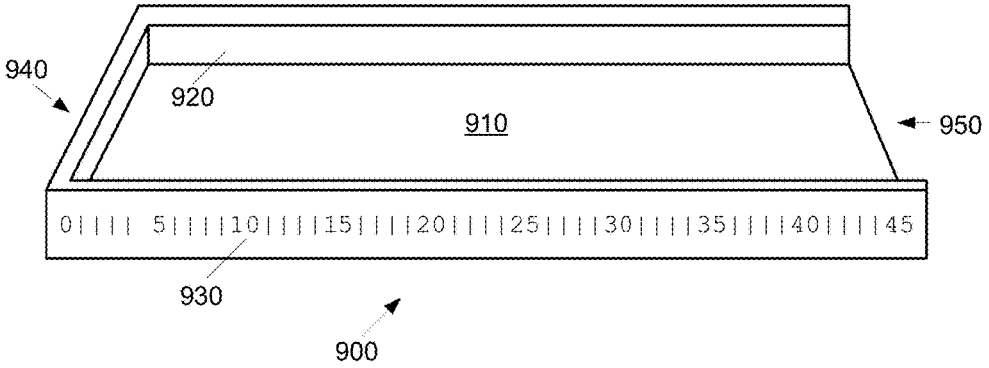
FIG. 9A is a schematic drawing from a first perspective of a first exemplary embodiment of a deployment surface for use with an exemplary arm and or leg rehabilitation device.
Figure 9B:
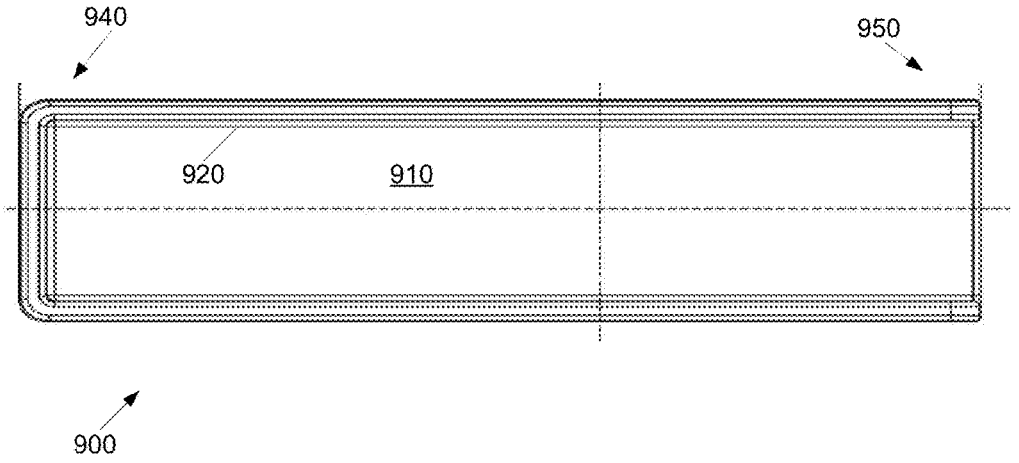
FIG. 9B is a schematic drawing from a second perspective of the first exemplary embodiment of the deployment surface for use with an exemplary arm and or leg rehabilitation device.

The rolling leg device 400, low bias arm rehabilitation device 500, and/or the low bias leg rehabilitation device 600 may be used as part of a rehabilitation system. For example, the rolling leg device 400, low bias arm rehabilitation device 500, and/or the low bias leg rehabilitation device 600 may be used in conjunction with a deployment surface 900 (or guide surface), a first exemplary embodiment of which is shown in FIGS. 9A-9B. The deployment surface 900 includes a substantially flat surface 910, configured such that the rolling leg device 400, low bias arm rehabilitation device 500, and/or the low bias leg rehabilitation device 600 may roll or slide over the flat surface 910. The flat surface 910 is preferably smooth and/or low in friction to accommodate rolling and/or sliding of the rolling leg device 400, low bias arm rehabilitation device 500, and/or the low bias leg rehabilitation device 600 over the flat surface 910. For example, the flat surface 910 may be coated with a low friction polymer material, and/or may otherwise be polished.

Figure 10:
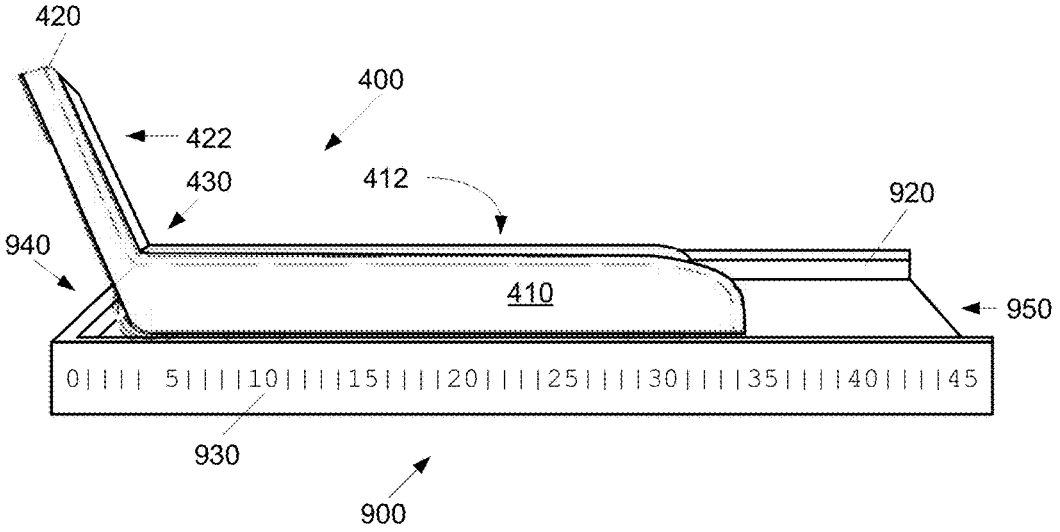
FIG. 10 is a schematic diagram of the exemplary embodiment of the deployment surface used with the exemplary rolling leg device of FIG. 4D.

The flat surface 910 may be bounded on one, two, three, or more sides with a raised edge 920 attached to the flat surface 910. The raised edge 920 may assist in confining the motion of the rolling leg device 400, low bias arm rehabilitation device 500, and/or the low bias leg rehabilitation device 600 within the deployment surface 900. FIG. 10 shows the rolling leg device 400 as used with the deployment surface 900. The low bias arm rehabilitation device 500, and/or the low bias leg rehabilitation device 600 may be used with the deployment surface 900 in a similar fashion. The dimensions of the deployment surface 900 may be chosen to accommodate the rolling leg device 400, low bias arm rehabilitation device 500, and/or the low bias leg rehabilitation device 600.

There may be a scale 930 drawn, engraved, or embossed upon the raised edge 920, whereby the motion of the low bias leg rehabilitation device 400, 600 and/or low bias arm rehabilitation device 500 may be measured. While FIG. 9A shows the scale 930 on the exterior side portion of the raised edge 920, the scale 930 may alternatively or additionally displayed on the inside portion of the raised edge 920 and/or the top surface of the raised edge 920. The scale 930 may include numbers, letters, or other symbols indicating the range of motion of a low bias leg rehabilitation device 400, 600 and/or low bias arm rehabilitation device 500 within the deployment surface 900. This may be desirable, for example, to measure changes in the range of motion of the wearer of the low bias leg rehabilitation device 400, 600 and/or low bias arm rehabilitation device 500 over subsequent uses. Alternatively, or in addition to a scale 930 on the raised edge 920, a scale may be presented upon the flat surface 910.

While the deployment surface 900 in the first embodiment is rectangular in shape, having a closed end 940 and an open end 950, in other embodiments the deployment surface 900 may have other shapes, for example, to facilitate motion and to measure range of motion in more than one direction. Similarly, in other embodiments, the raised edge 920 may be configurable to expand or restrict motion of the limb rehabilitation device 400, 500, 600 by moving the raised edge 920 inward or outward from an edge of the flat surface 910.

Under the first embodiment, the deployment surface 900 may be formed with the substantially flat surface 910 being approximately 28 inches long by 7.5 inches wide, along the two 28 inch long raised edges 920 having a rise of approximately 1.5 inches, being approximately ⅜ inches thick, and a third raised edge 920 at the bottom of the substantially flat surface 910, being approximately 1.5 inches high by 7.5 inches wide by ⅜ inches thick. While the raised edges 920 are connected under the first embodiment, there may be gaps between the raised edges 920 in alternative embodiments. Under the first embodiment, there is not a raised edge 920 opposite the third raised edge.

The deployment surface 900 may be made of one or more of several appropriate materials conducive to supporting and facilitating motion of the leg rehabilitation devices 400, 600 and/or low bias arm rehabilitation device 500, for example, wood or plastic, such as polypropylene. For example, a deployment surface 900 formed of polypropylene may be formed using an injection mold.

For example, the deployment surface 900 may be used as a guide to accommodate the low bias leg rehabilitation device 600. As described above, the low bias leg rehabilitation device 600 is a rehabilitation device that helps build back leg muscle after, for example, stroke or injuries to the affected leg. A patient lies down and with the low bias leg rehabilitation device 600 attached to the affected leg, and the patient may bend the affected leg at the knee and roll the low bias leg rehabilitation device 600 upon the deployment surface 900. The raised edges 920 will hold the device in place while the patient is exercising the affected leg. As the patient moves the low bias leg rehabilitation device 600 up and down the deployment surface 900, the scale 930 allows for gauging the progress or plateau of the patient, by noticing at what point along the scale the skate stops progress, enabling, for example, a doctor or physical therapist attending the patient to document the findings at that time. The deployment surface 900 may be used in a similar fashion with the rolling leg device 400 and/or the low bias arm rehabilitation device 500.

Figure 8:
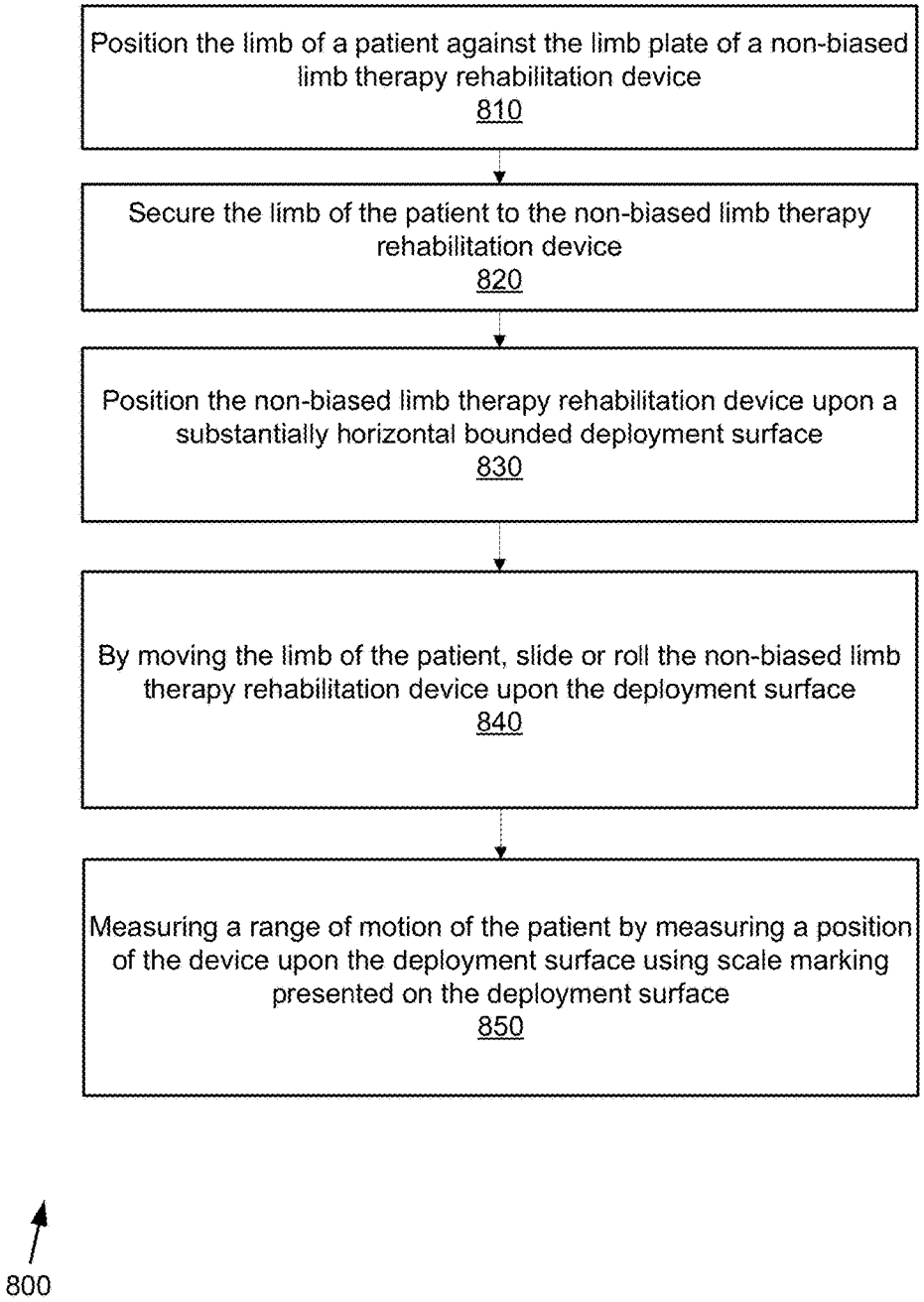
FIG. 8 is a flowchart of an exemplary method for exercising a limb with a non-biased limb therapy rehabilitation system.

FIG. 8 is a flowchart of an exemplary method for exercising a limb with a non-biased limb therapy rehabilitation device 500, 600 and deployment surface 900. The limb of a patient is positioned against the limb plate 510, 610 of a non-biased limb therapy rehabilitation device, as shown by block 810. The limb of the patient is secured to the non-biased limb therapy rehabilitation device 500, 600, for example, using straps 570, 670, as shown by block 820. The non-biased limb therapy rehabilitation device 500, 600 is positioned upon a substantially flat and/or horizontal surface, as shown by block 830. For example, non-biased sliding/rolling elements 560, 660 disposed on the underside of the non-biased limb therapy rehabilitation device 500, 600 may be positioned adjacent to the horizontal surface. By moving the limb of the patient, the non-biased limb therapy rehabilitation device 500, 600 is slid/rolled upon the substantially horizontal surface 900, as shown by block 840. A range of motion of the patient by is measured by measuring a position of the device 500, 600 upon the deployment surface 900 using scale marking 930 presented on the deployment surface, as shown by block 850.

Figure 11:
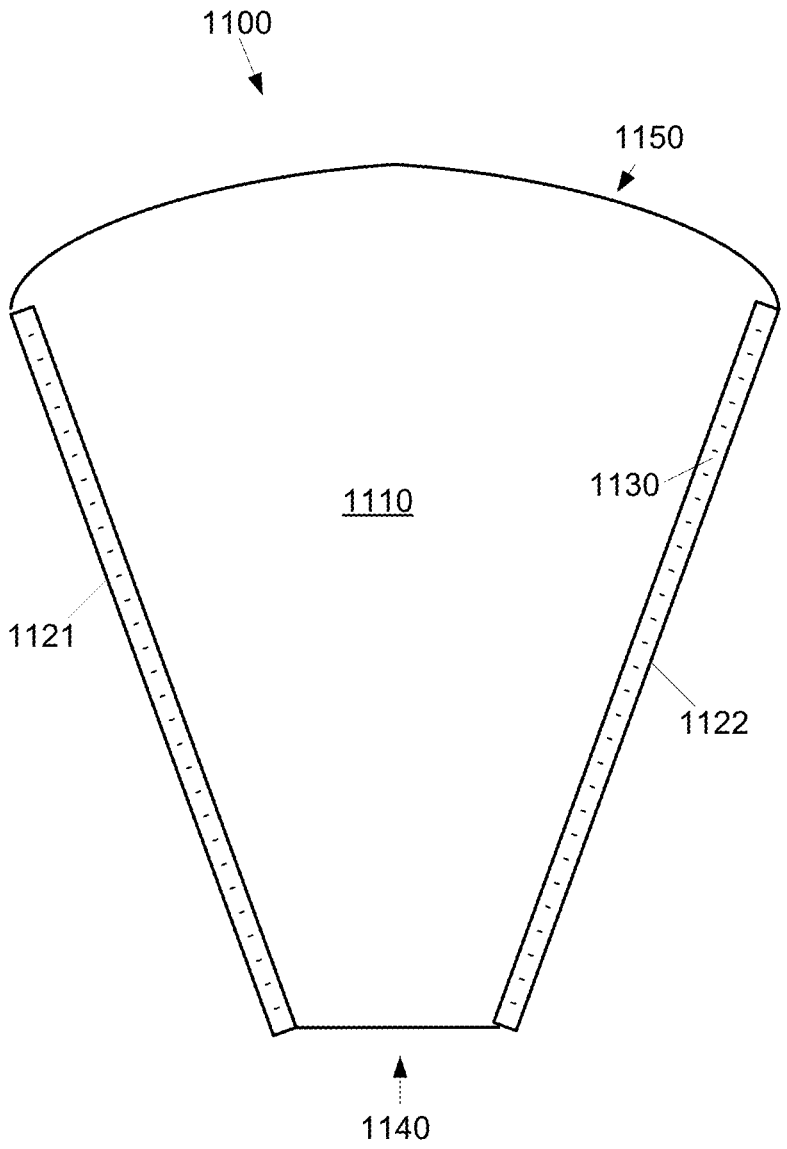
FIG. 11 is a schematic drawing of a second exemplary embodiment of a deployment surface for use with an exemplary arm and/or leg rehabilitation device.

While FIGS. 9A-B depict the first embodiment deployment surface as being substantially rectangular, other configurations are possible. For example, FIG. 11 shows a second embodiment of a deployment surface 1100 where a first raised edge 1121 and a second raised edge 1122 are not parallel but rather increasingly separate as they extend outward from a proximal end 1140 of a flat surface 1110 toward a distal end 1150 of the flat surface 1110. While FIG. 11 shows the deployment surface 1100 having an open proximal end 1140 and an open distal end 1150, in alternative embodiments the proximal end 1140 and/or the distal end 1150 of the flat surface 1110 may be bounded by a raised edge (not shown), to retain the device 400, 500, 600 over the flat surface. A scale 1130 may be displayed on one or more surfaces of the first raised edge 1121 and/or the second raised edge. For example, a first edge may display a first scale in inches, and a second edge may display a second scale in metric measurements.

Figure 12:
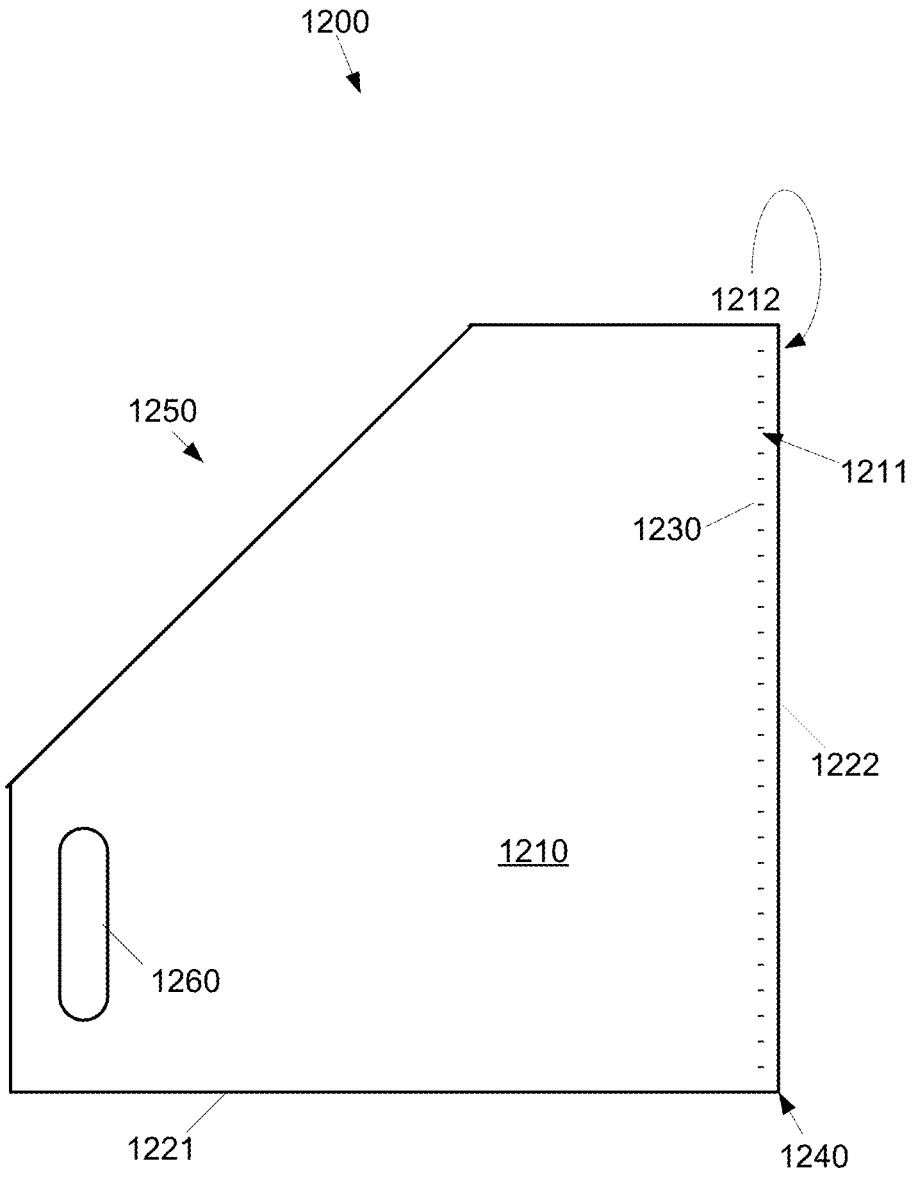
FIG. 12 is a schematic drawing of a third exemplary embodiment of a deployment surface for use with an exemplary arm and/or leg rehabilitation device.

FIG. 12 shows a third embodiment of a deployment surface 1200 where a first non-raised edge 1221 and a second non-raised edge 1222 separate as they extend outward from a proximal corner 1240 of a flat surface 1210 toward a distal end 1250 of the flat surface 1210. A scale 1230 may be displayed on a top side 1211 and/or a bottom side 1212 of the flat surface 1210. For example, a first edge may display a first scale in inches, and a second edge may display a second scale in metric measurements. A handle aperture 1260 may be disposed through the flat surface 1210.

In summary, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A physical therapy device comprising:

a limb supporting plate configured to support the limb of a user, the limb supporting plate further comprising a limb supporting plate first surface and a limb supporting plate second surface disposed opposite the limb supporting plate first surface;

an extremity support connected to the limb supporting plate at a joint between the extremity support and the limb supporting plate, the extremity support further comprising an extremity support first surface configured to support an extremity of the limb and an extremity support second surface disposed opposite the extremity support first surface;

a fastener configured to secure the limb of the user to the limb supporting plate first surface;

a plurality of ball transfer casters attached to and protruding from the second surface of the limb supporting plate; and a rolling element disposed at the joint between the extremity support and the limb supporting plate and configured to protrude from the second surface of the limb supporting plate at a lesser distance than the plurality of ball transfer casters.

2. The physical therapy device of claim 1, wherein the extremity support and the limb supporting plate are integrally formed.

3. The physical therapy device of claim 1, wherein the fastener comprises a flexible strap.

4. The physical therapy device of claim 3, wherein the flexible strap includes a hook and loop fastening system.

5. The physical therapy device of claim 1, wherein the first surface of the limb supporting plate is contoured to accommodate the limb of the user.

6. The physical therapy device of claim 1, wherein the first surface of the limb supporting plate is padded to accommodate the limb of the user.

7. The physical therapy device of claim 1, wherein the extremity support second surface is oriented at an angle in the range of 75-130 degrees in relation to the limb supporting plate second surface.

8. A physical therapy system comprising:

a rehabilitation device; and a deployment surface, wherein the rehabilitation device comprises:

a limb supporting plate configured to support the limb of a user, the limb supporting plate further comprising a limb supporting plate first surface and a limb supporting plate second surface disposed opposite the limb supporting plate first surface;

an extremity support connected to the limb supporting plate at a joint between the extremity support and the limb supporting plate, the extremity support further comprising an extremity support first surface configured to support an extremity of the limb and an extremity support second surface disposed opposite the extremity support first surface;

a fastener configured to secure the limb of the user to the limb supporting plate first surface;

a plurality of ball transfer casters attached to and protruding from the second surface of the limb supporting plate; and a rolling element disposed at the joint between the extremity support and the limb supporting plate and configured to protrude from the second surface of the limb supporting plate at a lesser distance than the plurality of ball transfer casters, and wherein the deployment surface comprises:

a substantially flat surface configured such that the rehabilitation device may roll or slide over the flat surface;

a first edge;

a second edge; and a measuring scale comprising display markings indicating distance presented on the first edge, the second edge or the flat surface and configured to facilitate measurement of the range of motion of the rehabilitation device over the deployment surface.

9. The physical therapy system of claim 8, wherein:

the first edge further comprises a raised edge attached to a first edge of the flat surface; and the second edge further comprises a raised edge attached to a second edge of the flat surface, wherein the raised edges are configured to confine motion of the limb rehabilitation device over the deployment surface.

10. The physical therapy system of claim 8, wherein the measuring scale is presented in inches, metric measurements, or both.

* * * * *